US006019431A

United States Patent [19]

Rexus et al.

[11] Patent Number: 6,019,431

[45] Date of Patent: Feb. 1, 2000

[54] YARD WASTE HANDLING APPARATUS

[76] Inventors: William V. Rexus, 200491 County Rd. P, Gering, Nebr. 69341; Douglas A. Rexus, 2002 Broadway, Mitchell, Nebr. 69357

[21] Appl. No.: 08/753,098

[22] Filed: Nov. 20, 1996

[51] Int. Cl.[7] ..... B65F 03/00

[52] U.S. Cl. ..... 298/23 MD; 298/18; 414/487

[58] Field of Search ..... 298/18, 23 MD; 414/487

[56] References Cited

U.S. PATENT DOCUMENTS

| | | | |
|---|---|---|---|
| 3,236,562 | 2/1966 | Maxon, Jr. | 298/23 MD X |
| 3,627,159 | 12/1971 | Smith | 298/23 MD X |
| 4,068,891 | 1/1978 | Herbst | 298/7 |
| 4,327,945 | 5/1982 | Fowler | 298/11 |
| 4,470,747 | 9/1984 | Tichenor | 414/491 |
| 4,494,798 | 1/1985 | Bailey | 298/17.6 |
| 4,709,541 | 12/1987 | Broman et al. | 56/202 |
| 4,981,411 | 1/1991 | Ramsey | 414/487 |
| 4,989,917 | 2/1991 | Schmidt, Jr. | 298/11 |
| 5,035,564 | 7/1991 | Matsumoto | 414/487 X |
| 5,141,288 | 8/1992 | Smith | 298/17.6 |
| 5,252,020 | 10/1993 | Kinney et al. | 414/346 |
| 5,316,430 | 5/1994 | Horning et al. | 414/407 |
| 5,431,481 | 7/1995 | Boyer | 298/35 R |

*Primary Examiner*—Janice L. Krizek
*Attorney, Agent, or Firm*—Zarley, McKee, Thomte Voorhees & Sease

[57] ABSTRACT

A yard waste handling apparatus includes a trailer with a dump box operably mounted on the forward end and a tailgate pivotally mounted on the rearward end. The tailgate may be pivoted from a vertical position to a loading position sloped downwardly to the ground. The dump box has an operable front wall which may be pivoted to an open position to permit dumping of the contents from the dump box. A hydraulic scissors hoist under the dump box and connected to the trailer frame is operable to pivot the dump box about the forward edge of the bottom of the dump box to thereby dump the contents of the dump box to one side of the trailer. A hopper is mounted on a lift arm which is operably mounted to the dump box, the lift arm raising the hopper from a loading position on the ground to a raised position adjacent the open upper end of the dump box. An hydraulic cylinder connected between the hopper and the lift arm is operable to pivot the hopper to a dumping position over the open upper end of the dump box.

20 Claims, 6 Drawing Sheets

YARD WASTE HANDLING APPARATUS

TECHNICAL FIELD

The present invention relates generally to containers for yard waste, and more particularly to an improved yard waste handling apparatus for the efficient storage and transport of grass clippings and other debris, in addition to the transport of associated lawn equipment.

BACKGROUND OF THE INVENTION

Commercial lawn mowing businesses typically utilize a trailer to transport the lawn equipment associated with the business and then have a separate truck or trailer for hauling grass clippings, limbs and other debris associated with the business. One of the main problems suffered by conventional commercial lawn businesses, is the time required to load grass clippings in bags or onto the back of trucks. In addition, it is an arduous task to unload the yard waste at the landfill or other designated site.

A further problem associated with the majority of commercial lawn businesses is the loading and unloading of equipment from trailers. Typically, ramps must be lifted and installed in position to roll the equipment onto and off of the trailer.

SUMMARY OF THE INVENTION

It is therefore a general object of the present invention to provide an improved yard waste handling apparatus.

A further object is to provide a yard waste handling apparatus which provides a large container for storing yard waste, and an automated dump box for loading the container.

Yet another object of the present invention is to provide a trailer with a dump box, and space for hauling associated lawn equipment.

Yet a further object is to provide a yard waste handling apparatus with powered ramps for the easy loading and unloading of equipment from the trailer.

Still another object of the present invention is to provide a yard waste handling apparatus which is simple to use, and efficient in operation.

These and other objects of the present invention will be apparent to those skilled in the art.

The yard waste handling apparatus of the present invention includes a trailer with a dump box operably mounted on the forward end and a tailgate pivotally mounted on the rearward end. The tailgate may be pivoted from a vertical position to a loading position sloped downwardly to the ground. The dump box has an operable front wall which may be pivoted to an open position to permit dumping of the contents from the dump box. A hydraulic scissors hoist under the dump box and connected to the trailer frame is operable to pivot the dump box about the forward edge of the bottom of the dump box to thereby dump the contents of the dump box to one side of the trailer. A hopper is mounted on a lift arm which is operably mounted to the dump box, the lift arm raising the hopper from a loading position on the ground to a raised position adjacent the open upper end of the dump box. An hydraulic cylinder connected between the hopper and the lift arm is operable to pivot the hopper to a dumping position over the open upper end of the dump box.

DESCRIPTION OF THE PREFERRED EMBODIMENT

Figure 1:
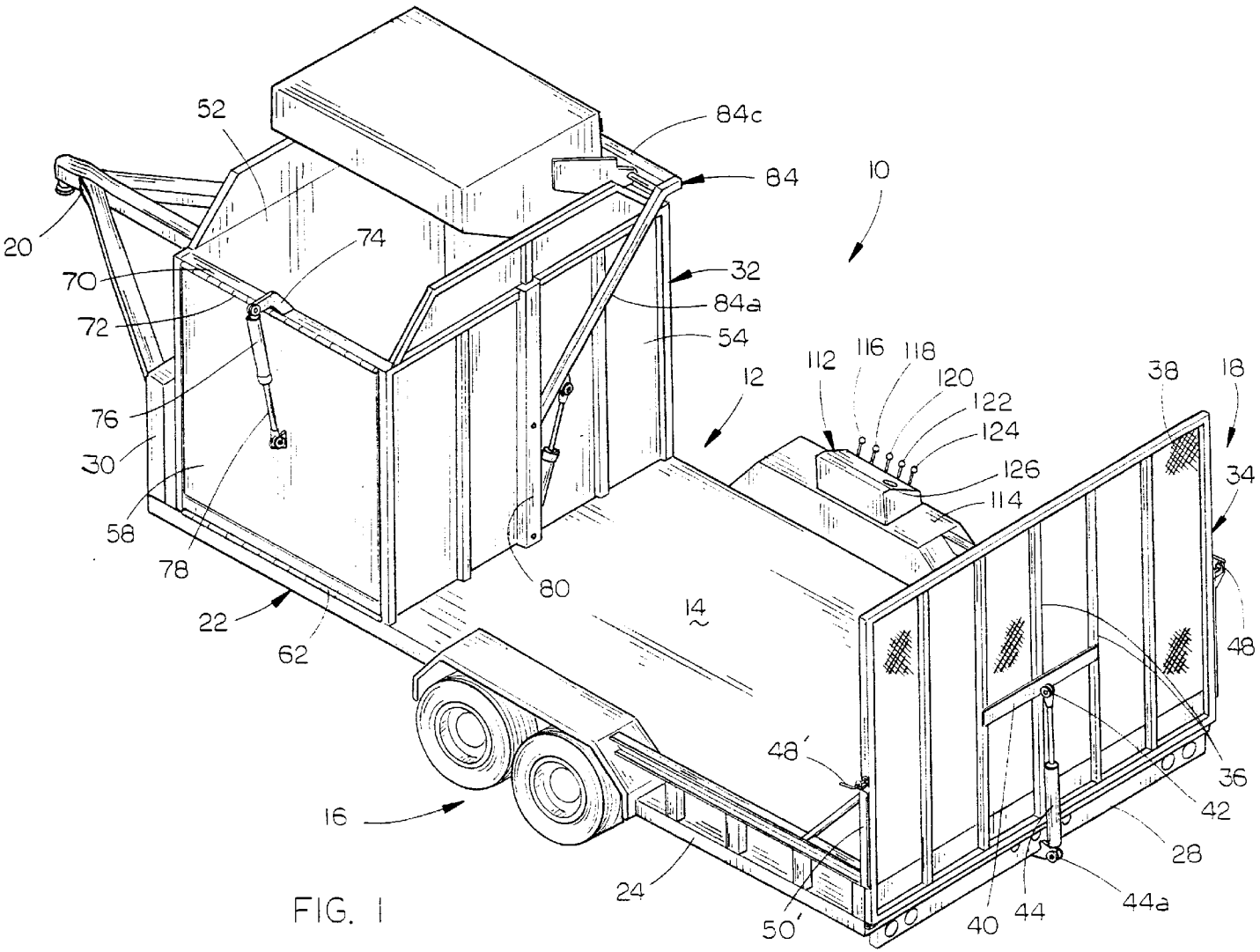
FIG. 1 is a perspective view of the invention.

Referring now to the drawings, in which similar or corresponding parts are identified with the same reference numeral and more particularly to FIG. 1, the yard waste handling apparatus of the present invention is designated generally at 10 and includes a trailer 12 with a flat bed 14 supported on a wheel set 16, with an operable tailgate pivotally connected to a rearward end thereof, and a gooseneck type hitch 20 mounted on a forward end thereof.

Trailer 12 includes a generally rectangular frame 22 having opposing side members 24 and 26, a rearward cross-member 28, and a forward bulkhead 30. A 400 bushel dump box 32 is connected to the frame 22 at the forward end thereof adjacent bulkhead 30. Bed 14 extends rearwardly from dump box 32 to the rearward cross-member 28, for supporting various lawn equipment on trailer 12.

Tailgate 18 includes a generally rectangular frame 34 with auxiliary support bars 36 mounted between the sides of the frame for additional strength. An expanded metal sheet 38 is mounted to one side of the frame and extends completely there across to form an upper surface upon which lawn equipment may be supported while loading and unloading trailer 12.

A crossbar 40 extends across and is mounted to a plurality of the auxiliary support bars 36, and is generally centered on the bottom of frame 34. The extensible rod 42 of a double acting cylinder 44 is pivotally connected to crossbar 40, and a lower end 44*a* of cylinder 44 is pivotally connected to the rearward cross-member 28. In this way, tailgate 18 may be mechanically lowered by retracting rod 42 within cylinder 44, as shown by arrow 46 in FIG. 2. Tailgate 18 is raised to a vertical position by reversing the process and extending rod 42. A retractable pin 48 is operably mounted to the upper end of a stanchion 50, and is operable between a locked position engaging the tailgate frame 34 and an unlocked position permitting pivotal movement of tailgate 18. Stanchion 50 is mounted in an upright position at the rearward end of side member 26, to maintain tailgate 18 in a vertical position when pin 48 is moved to the locked position. A similar pin 48' and stanchion 50' are located on the opposite side of tailgate 18 at the rearward end of side member 24, as shown in FIG. 1, to selectively lock the other side of tailgate 18 in the vertical position.

Figure 2:
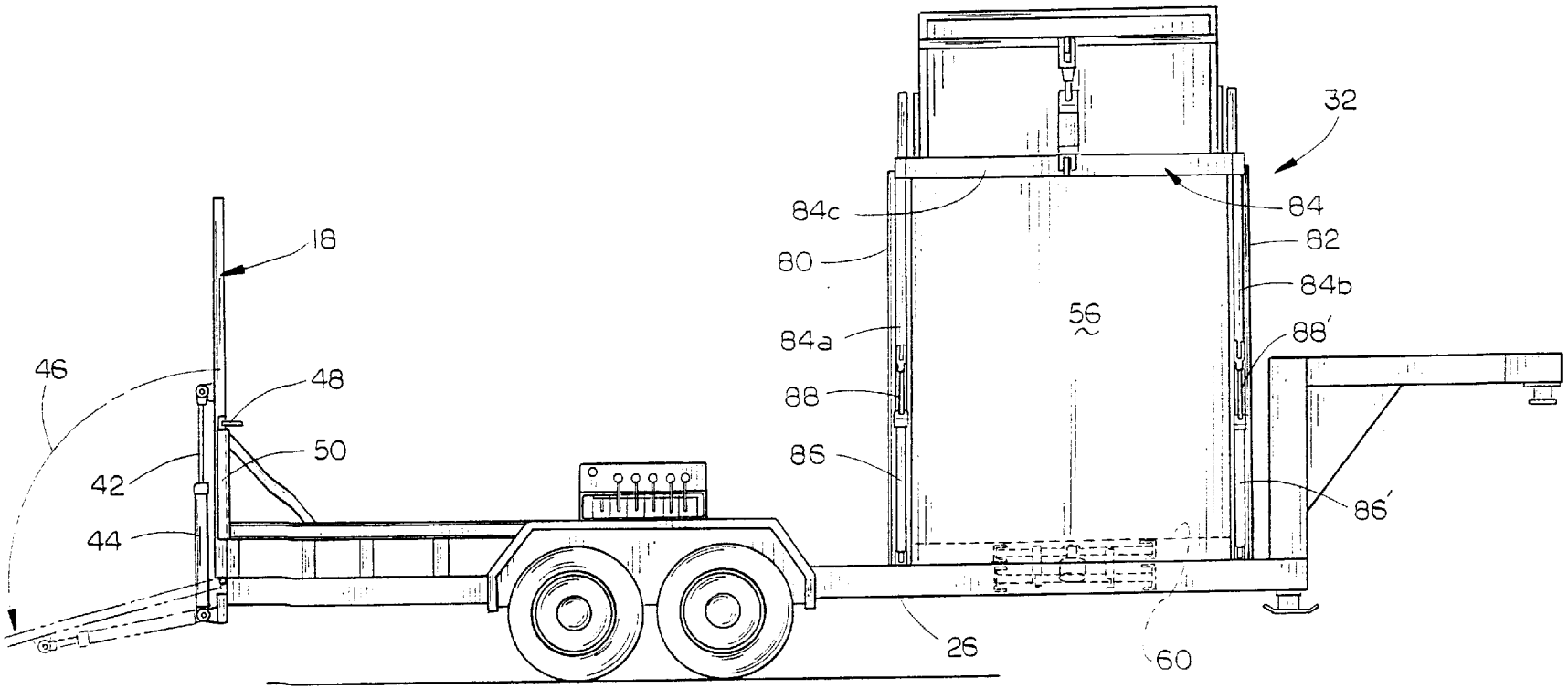
FIG. 2 is a side elevational view of the invention.
Figure 3:
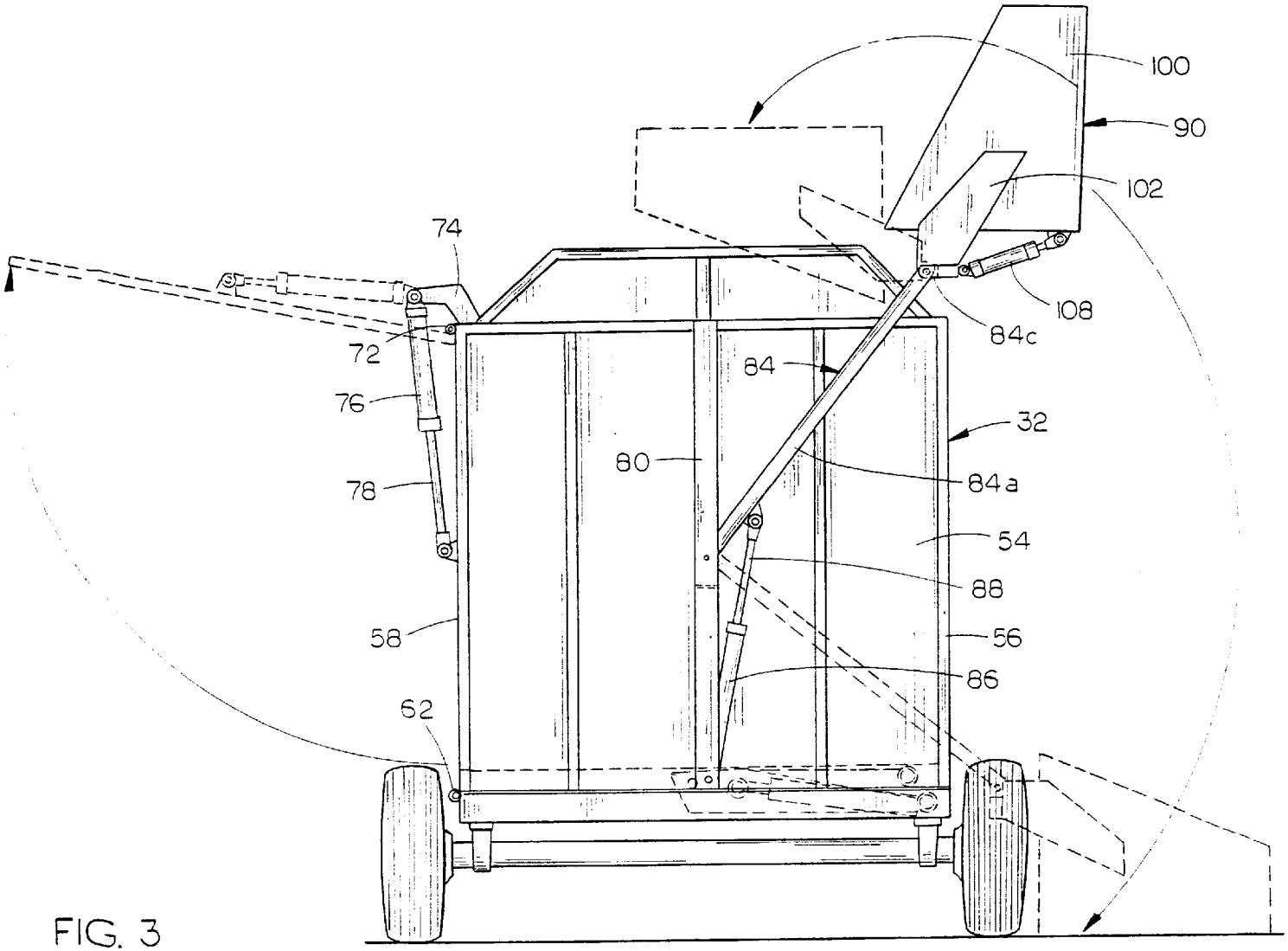
FIG. 3 is a rearward end elevational view of the invention.
Figure 4:
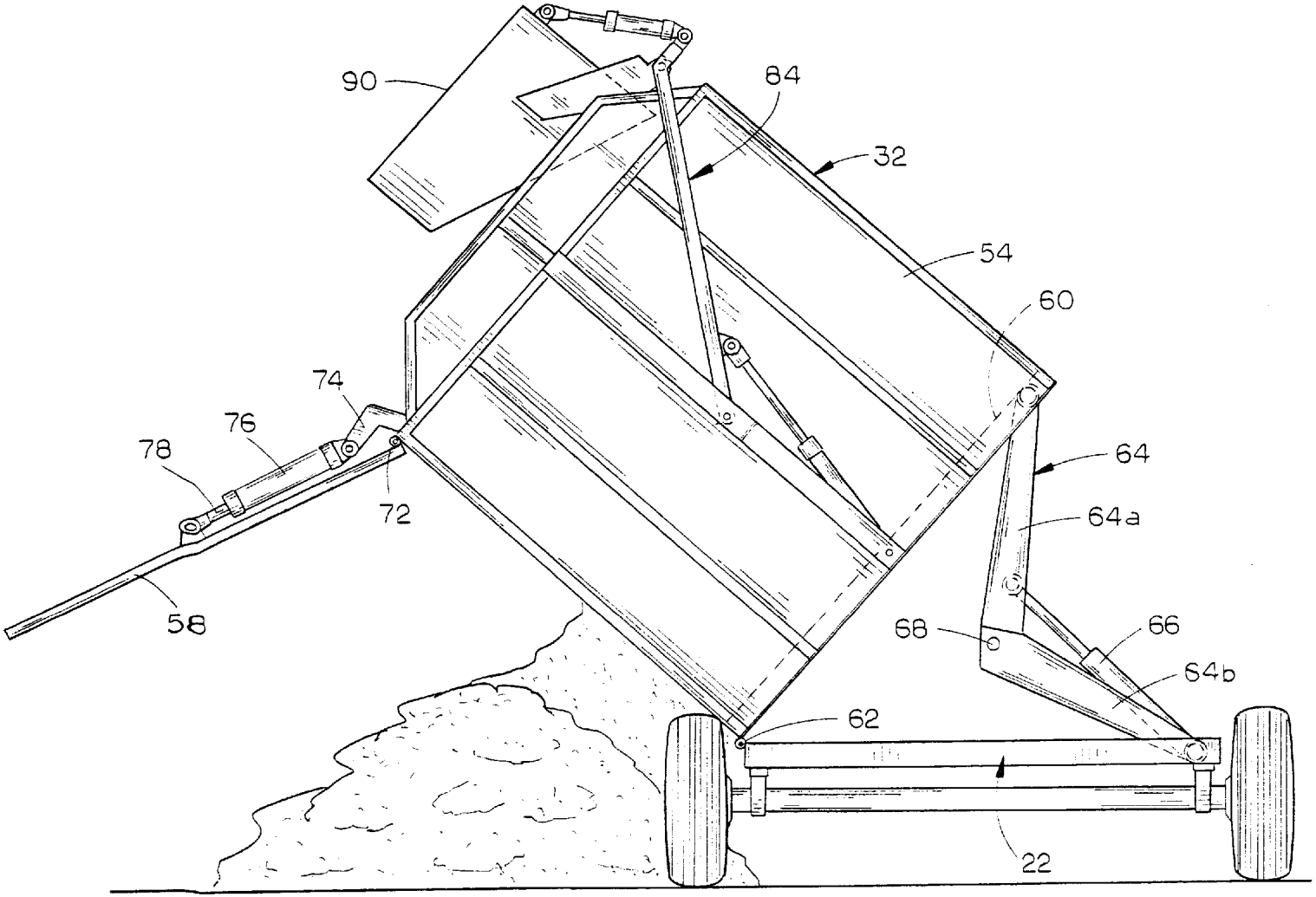
FIG. 4 is a view similar to FIG. 3, with the dump box operated to a dumping position.

Referring now to FIGS. 1–4, dump box 32 includes forward and rearward walls 52 and 54, a back wall 56, an operable front wall 58, and a bottom 60. Dump box 32 is pivotally connected along the front edge of bottom 60 by a hinge 62, with the back edge of bottom 60 resting on frame side member 26. As shown in FIG. 4, a scissors hoist 64 has a lower end connected to the trailer frame 22 and the upper end connected to the dump box bottom 60 adjacent the back edge thereof. Hydraulic cylinder 66 pivots upper and lower legs 64*a* and 64*b* of scissors hoist 64 about a pivot pin 68 to expand hoist 64 from a folded retracted position (shown in FIGS. 2 and 3) to an extended dump position (shown in FIG. 4), to selectively pivot dump box 32 on hinge 62.

Front wall 58 is pivotally connected along its upper edge to a support beam 70 extending between the upper front corners of forward and rearward walls 52 and 54, at a hinge 72. An arm 74 is cantilevered outwardly from the center of support beam 70 and has one end of a cylinder 76 pivotally connected thereto. Rod 78 of cylinder 76 is pivotally connected to front wall 58 near the center thereof, and is retractable to pivot front wall 58 about hinge 72, as shown in FIGS. 3 and 4, to thereby permit the dumping of the contents of dump box 32.

A column 80 is mounted on the outward face of rearward wall 54, for movement with dump box 32. A similar column 82 is mounted on the outer surface of forward wall 52, diametric to column 80. A generally U-shaped lift arm 84 has one leg 84*a* pivotally connected to column 80, the opposite leg 84*b* pivotally connected to column 82, and a base leg 84*c* connecting the opposite ends of legs 84*a* and 84*b*. As shown in FIG. 3, lift arm 84 is pivotable from a lower position shown in broken lines to an upper position shown in solid lines, with base leg 84*c* moving through an arc outwardly of dump box back wall 56. A cylinder 86 has a lower end pivotally connected at the bottom of column 80, and the extensible rod 88 thereof pivotally connected to lift arm leg 84*a*. A matching cylinder 86' and associated rod 88' are operably mounted between the lower end of column 82 and lift arm leg 84*b*. Cylinders 86 and 86' are operable to raise and lower lift arm 84, as shown in FIG. 2.

Figure 6:
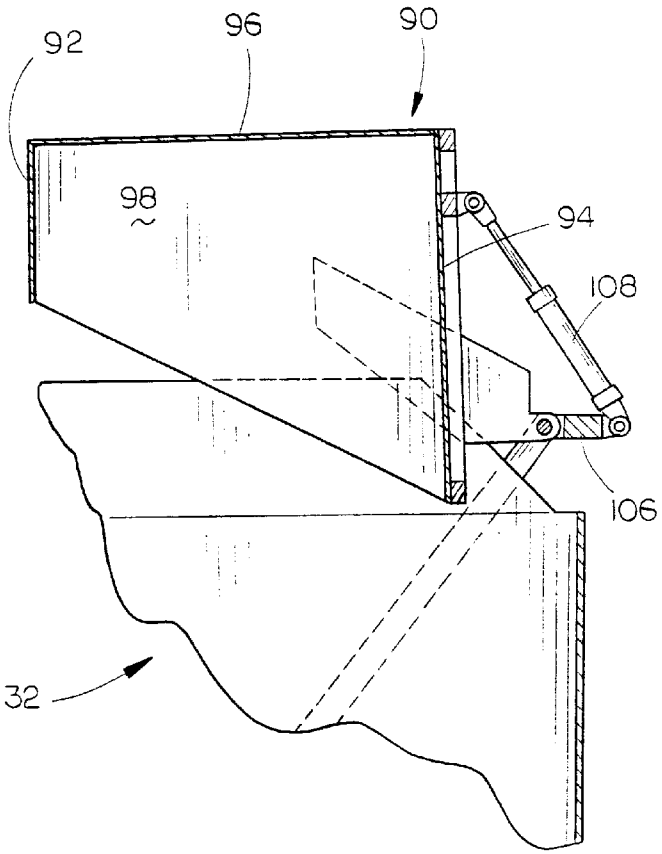
FIG. 6 is a view similar to FIG. 5, but with the loading hopper moved to a dumping position.
Figure 5:
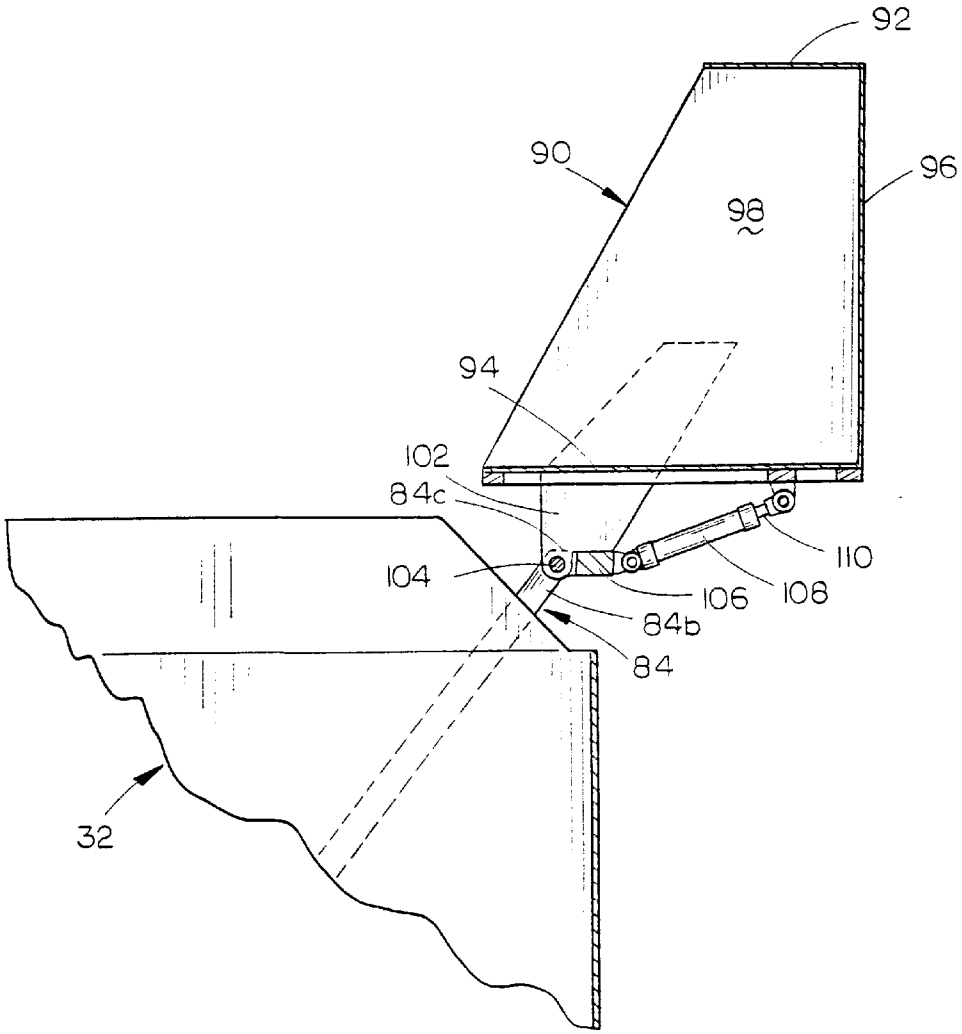
FIG. 5 is an enlarged rearward end elevational view of a portion of the dump box with an associated loading hopper moved to an upper position.

Lift arm 84 has a 14 bushel hopper 90 operably connected thereto, and serves to raise and lower hopper 90 to dump batches of yard waste from the hopper into dump box 32. As shown in FIGS. 5 and 6, hopper 90 includes a front wall 92, a back wall 94, a bottom 96, and opposing side walls 98 and 100 (side wall 100 being shown in FIG. 3). Hopper 90 is pivotally supported on lift arm 84 by a pair of support brackets 102 attached to the outer surfaces of side walls 98 and 100. A pivot axle 104 pivotally connects brackets 102 to lift arm 84 to pivot hopper 90 about axle 104. A pair of ears 106 are rigidly mounted to legs 84*a* and 84*b* and project outwardly from adjacent the base leg 84*c* thereof. A cylinder 108 is pivotally connected to the distal end of ears 106 with an extensible rod 110 pivotally connected to the back wall 94 of hopper 90. Cylinders 108 are extensible to pivot hopper 90 about axle 104 over the top of dump box 32, to empty the contents of hopper 90 into dump box 32, as shown in FIGS. 5 and 6. Referring once again to FIG. 1, a control panel 112 is mounted on a fender 114 of trailer 12 at a height which permits easy operation by a person either standing by the trailer or sitting atop a riding mower or similar piece of equipment. Control panel 112 includes five actuator levers 116, 118, 120, 122, and 124 operably mounted thereon to control the various cylinders of yard waste handling apparatus 10 as described in more detail hereinbelow. A safety switch 126 is also provided on control panel 112 to selectively engage or disengage an hydraulic pump 128 (shown in FIG. 7).

Figure 7:
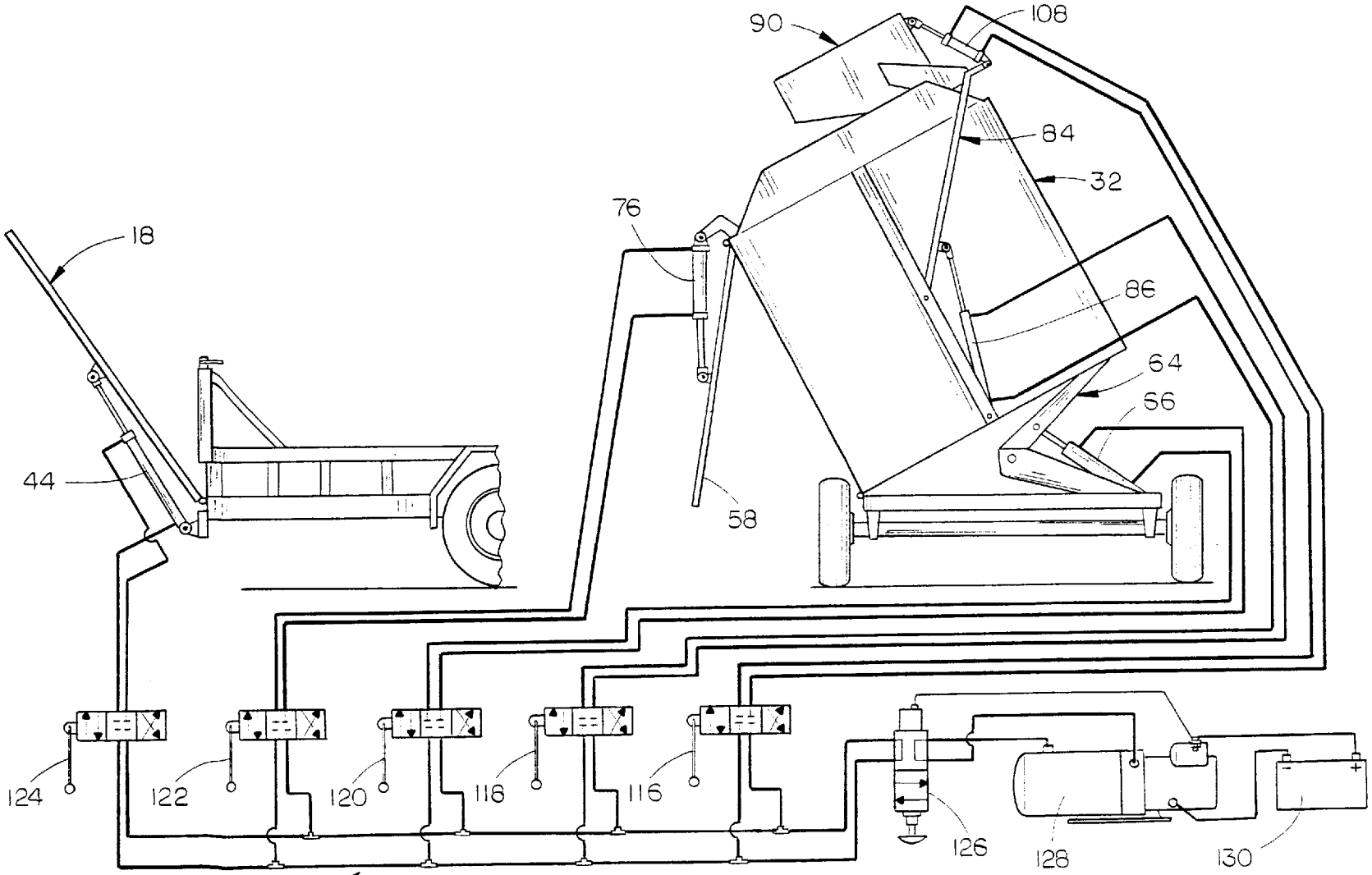
FIG. 7 is a schematic view of the hydraulics for operating the invention.

Referring now to FIG. 7, the hydraulic system of the present invention is shown in schematic diagram. A conventional 12 volt deep cycle marine battery 130 will power the hydraulic pump 128 for an entire day. The battery may then be charged overnight and during the day from the vehicle's charging system to operate the yard waste handling apparatus 10. Safety switch 126 interconnects the supply and return lines of hydraulic pump 128 with the hydraulic circuit 132 of the yard waste handling apparatus. Safety switch 126 prevents accidental operation of any of the hydraulic cylinders on the apparatus 10 until switch 126 is activated.

As shown in FIG. 7, the first actuator lever 116 connects the hydraulic lines to cylinder 108, to selectively pivot the hopper 90. Second actuator lever 118 is hydraulically connected to cylinder 86 to selectively raise and lower lift arm 84. Third actuator lever 120 is hydraulically connected to cylinder 66 on scissors hoist 64, to selectively pivot dump box 32 between the storage and dumped positions. Fourth hydraulic lever 122 is connected to cylinder 76, to selectively open and close front wall 58 of dump box 32. Finally, fifth actuator lever 124 is connected to cylinder 44, to selectively raise and lower tailgate 18.

Whereas the invention has been shown and described in connection with the preferred embodiment thereof, many modifications, substitutions and additions may be made which are within the intended broad scope of the appended claims.

We claim:

1. A yard waste handling apparatus, comprising:

a wheeled trailer having a frame with forward and rearward ends, a hitch on the forward end for attachment to a prime mover; and opposing side members;

a dump box operably mounted on the forward end of the trailer for pivotal movement between a loading position at rest on the trailer frame, and a dumping position pivoted relative to the trailer frame;

said dump box having an open upper end, opposing forward and rearward walls, opposing front and back walls, and a bottom;

said dump box front wall operably connected to the dump box for movement between open and closed positions;

means for selectively pivoting the dump box, connected between the dump box and trailer frame; and means for selectively moving the dump box front wall, connected between the front wall and dump box;

wherein said dump box is pivotally mounted along a front edge of the bottom to one of said frame side members;

wherein said dump box includes a support beam extending between front ends of upper edges of the forward and rearward walls; and wherein the means for moving the front wall is connected between the front wall and the support beam.

2. The apparatus of claim 1, wherein said front wall is pivotally mounted along an upper edge to said support beam.

3. The apparatus of claim 2, further comprising a tailgate pivotally connected to the trailer frame rearward end for movement between a generally vertically oriented storage position, and a loading position sloped from the trailer frame to a ground surface.

4. The apparatus of claim 3, wherein said tailgate includes a support frame and a rigid sheet extending across the frame to form a surface for loading equipment onto the trailer.

5. The apparatus of claim 4, wherein said trailer includes a flat bed mounted on the trailer frame, extending from the dump box to the frame rearward end.

6. The apparatus of claim 5, further comprising means for selectively pivoting the tailgate, connected between the tailgate and the trailer frame rearward end.

7. The apparatus of claim 6, wherein said tailgate is pivotally mounted along a lower edge of the support frame to the trailer frame rearward end.

8. The apparatus of claim 7, further comprising an operable lock mounted on each trailer frame side member at a rearward end, for selectively locking the tailgate in the storage position.

9. The apparatus of claim 8, further comprising a hopper, having an open upper end, opposing front and back walls, opposing side walls and a bottom, operably mounted on the dump box for movement between an upright loading position located on the ground surface proximal the trailer, and an inverted dumping position located over the upper end of the dump box.

10. The apparatus of claim 9, further comprising means for selectively moving the hopper between the loading position and dumping position.

11. The apparatus of claim 10, wherein said means for moving the hopper includes:

first means for lifting the hopper vertically from the loading position to a raised position intermediate the loading and dumping positions; and second means for pivoting the hopper between the raised position and the dumping position;

said first and second means being independently operable.

12. The apparatus of claim 11, wherein the first means for lifting the hopper includes a lift arm pivotally connected at a first end to the dump box, and a second end connected to the hopper, with an operable cylinder connected between the dump box and the lift arm to pivot the lift arm between raised and lowered positions.

13. The apparatus of claim 12, wherein the hopper is pivotally connected to the lift arm the second end, and wherein the second means for pivoting the hopper includes an operable cylinder connected between the hopper and the lift arm.

14. A yard waste handling apparatus, comprising:

a wheeled trailer having a frame with forward and rearward ends, a hitch on the forward, end for attachment to a prime mover; and opposing side members;

a dump box operably mounted on the forward end of the trailer for pivotal movement between a loading position at rest on the trailer frame, and a dumping position pivoted relative to the trailer frame;

said dump box having an open upper end, opposing forward and rearward walls, opposing front and back walls, and a bottom;

said dump box front wall operably connected to the dump box for movement between open and closed positions;

means for selectively pivoting the dump box, connected between the dump box and trailer frame;

means for selectively moving the dump box front wall, connected between the front wall and dump box; and a tailgate pivotally connected to the trailer frame rearward end for movement between a generally vertically oriented storage position, and a loading position sloped from the trailer frame to a ground surface.

15. The apparatus of claim 14, further comprising means for selectively pivoting the tailgate, connected between the tailgate and the trailer frame rearward end.

16. A yard waste handling apparatus, comprising:

a wheeled trailer having a frame with forward and rearward ends, a hitch on the forward end for attachment to a prime mover; and opposing side members;

a dump box operably mounted on the forward end of the trailer for pivotal movement between a loading position at rest on the trailer frame, and a dumping position pivoted relative to the trailer frame;

said dump box having an open upper end, opposing forward and rearward walls, opposing front and back walls, and a bottom;

said dump box front wall operably connected to the dump box for movement between open and closed positions;

means for selectively pivoting the dump box, connected between the dump box and trailer frame;

means for selectively moving the dump box front wall, connected between the front wall and dump box; and a hopper having an open upper end, opposing front and back walls, opposing side walls and a bottom, operably mounted on the dump box for movement between an upright loading position located on a ground surface proximal the trailer, and an inverted dumping position located over the upper end of the dump box.

17. The apparatus of claim 16, further comprising means for selectively moving the hopper between the loading position and the dumping position.

18. The apparatus of claim 17, wherein said means for moving the hopper includes:

first means for lifting the hopper vertically from the loading position to a raised position intermediate the loading and dumping positions; and second means for pivoting the hopper between the raised position and the dumping position;

said first and second means being independently operable.

19. The apparatus of claim 18, wherein the first means for lifting the hopper includes a lift arm pivotally connected at a first end to the dump box, and a second end connected to the hopper, with an operable cylinder connected between the dump box and the lift arm to pivot the lift arm between raised and lowered positions.

20. The apparatus of claim 19, wherein the hopper is pivotally connected to the lift arm second end, and wherein the second means for pivoting the hopper includes an operable cylinder connected between the hopper and the lift arm.

* * * * *